US011162759B1

(12) United States Patent
Aral

(10) Patent No.: US 11,162,759 B1
(45) Date of Patent: Nov. 2, 2021

(54) LOCK SYSTEM FOR HOLSTERS

(71) Applicant: SAMSUN YURT SAVUNMA SANAYI VE TICARET ANONIM SIRKET, Samsun (FR)

(72) Inventor: Utku Aral, Samsun (TR)

(73) Assignee: SAMSUN YURT SAVUNMA SANAYI VE TICARET ANONIM SIRKET, Samsun (TR)

( * ) Notice: Subject to any disclaimer, the term of this patent is extended or adjusted under 35 U.S.C. 154(b) by 0 days.

(21) Appl. No.: 16/981,297

(22) PCT Filed: Dec. 24, 2019

(86) PCT No.: PCT/TR2019/051202
§ 371 (c)(1),
(2) Date: Sep. 16, 2020

(87) PCT Pub. No.: WO2021/096453
PCT Pub. Date: May 20, 2021

(30) Foreign Application Priority Data

Nov. 12, 2019 (TR) ..... 2019/17533

(51) Int. Cl.
*F41C 33/02* (2006.01)
*F41C 33/04* (2006.01)

(52) U.S. Cl.
CPC ..... *F41C 33/0263* (2013.01); *F41C 33/0236* (2013.01); *F41C 33/045* (2013.01)

(58) Field of Classification Search
CPC ..... F41C 33/0263; F41C 33/0209; F41C 33/0227; F41C 33/0236; F41C 33/0254; F41C 33/02; F41C 33/04; F41C 33/041; F41C 33/045
See application file for complete search history.

(56) References Cited

U.S. PATENT DOCUMENTS

| | | | | |
|---|---|---|---|---|
| RE44,428 | E * | 8/2013 | Spielberger | F41C 33/0227 224/244 |
| 8,631,981 | B2 * | 1/2014 | Zusman | F41C 33/0263 224/244 |
| 10,495,411 | B1 * | 12/2019 | Tedder | F41C 33/045 |
| 10,996,024 | B2 * | 5/2021 | Smith | F41C 33/0263 |
| 2005/0035163 | A1 * | 2/2005 | French | F41C 33/045 224/243 |
| 2006/0226185 | A1 * | 10/2006 | Har-Shen | F41C 33/0263 224/244 |
| 2007/0181619 | A1 | 8/2007 | Seyfert et al. | |
| 2009/0224014 | A1 | 9/2009 | Kumuchian | |
| 2019/0293386 | A1 | 9/2019 | Smith et al. | |
| 2019/0331456 | A1 * | 10/2019 | Lecosnier | F41C 33/04 |
| 2020/0292272 | A1 * | 9/2020 | Treto | F41C 33/0227 |
| 2021/0278171 | A1 * | 9/2021 | Su | F41C 33/0263 |

* cited by examiner

*Primary Examiner* — Corey N Skurdal
(74) *Attorney, Agent, or Firm* — Bayramoglu Law Offices LLC

(57) ABSTRACT

A lock system for holsters includes: a lever, a picatinny rail release lever placed between a holster and a platform, a mounting apparatus, a body, a cover, a recess, a picatinny rail compression spring, a leg and waist buckle, a wing spring, a chest holster buckle, the buckle inner fixer, a buckle fixer fastener screwed to the buckle inner fixer, and the locking point. A pistol holster system is configured to be placed on a chest, a leg and a waist and prevents the pistol from exiting unintentionally when the pistol is inserted.

5 Claims, 15 Drawing Sheets

LOCK SYSTEM FOR HOLSTERS

CROSS REFERENCE TO THE RELATED APPLICATIONS

This application is the national stage entry of International Application No. PCT/TR2019/051202, filed on Dec. 24, 2019, which is based upon and claims priority to Turkish Patent Application No. 2019/17533, filed on Nov. 12, 2019, the entire contents of which are incorporated herein by reference.

TECHNICAL FIELD

The invention relates to a pistol holster system which can be placed on the chest, leg and waist and prevents the pistol from exiting unintentionally when the pistol is inserted.

SUMMARY

The invention relates to a locking system of a pistol holster designed to prevent unintentional displacement of the pistol placed in the holster, which is one of the major problems of pistol users. There are points in the system that grasp the gun from behind, the trigger cavity and through the lock channels of the picatinny rail. Thus, the gun is locked at three different points. In addition, with an easy pressing action, the user can free the gun from all three locking mechanisms and remove the gun from the holster. The balance to be established here is that the increased locking mechanisms in order to ensure the locking of the gun must be cancellable by the user in case of a sudden need to use a pistol. This is one of the points that distinguishes our invention from the methods used in the prior art. Furthermore, it can be mounted on both the leg equipment and the chest by means of its mounting apparatus.

Corresponding of the numbers and letters given in the figures:

21. Cord
22. Lever
23. Picatinny Rail Release Lever
24. Mounting Apparatus
24.1. Lock Wings
25. Body

26. Cover
27. Recess
28. Lever Screw
29. Screw
30. Lock Part Spring
31. Picatinny Rail Compression Spring
32. Lock Part
33. Leg and Waist Buckle
34. Wing Spring
35. Chest Holster Buckle
15.1 Adjusting Gear
36. Compression Spring
37. Buckle Inner Fixer
17.1 Levelled Part
38. Buckle Outer Fixer
39. Locking Point
40. Spring Channel
f. Waist Belt Slot
g. Leg Strap Slot
h. Leg Strap Slot
i. Chest Holster Holder
j. Chest Holster Hook

DETAILED DESCRIPTION OF THE EMBODIMENTS

Figure 1:
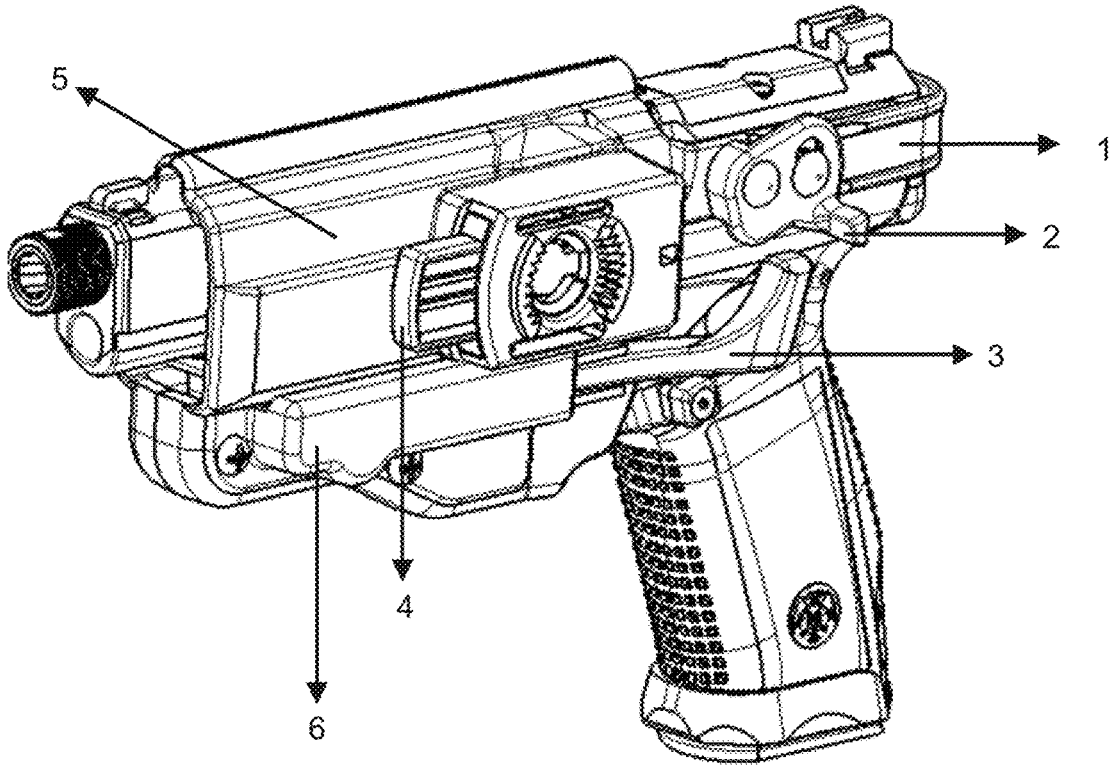
FIG. 1 Gun Mounted Holster without Platform.
Figure 2:
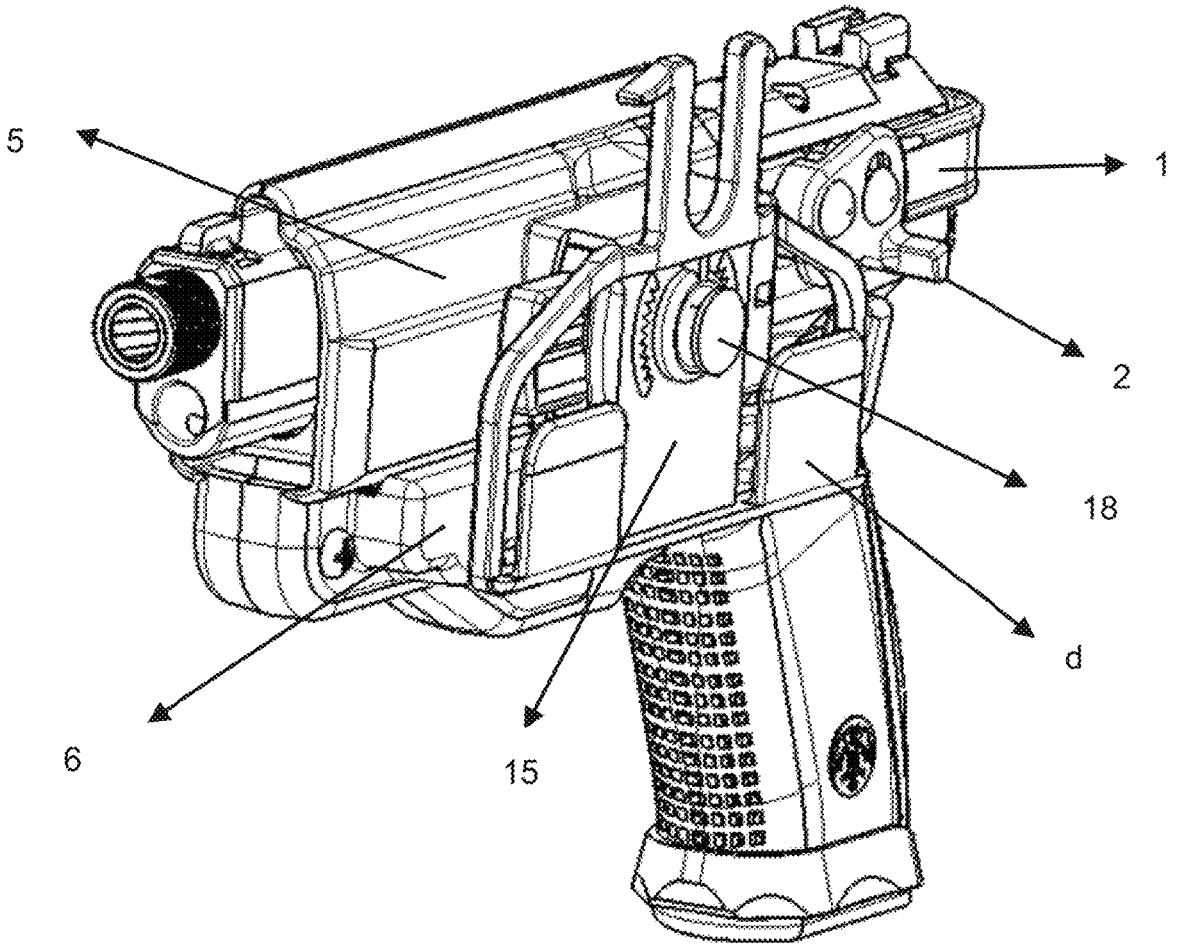
FIG. 2 Chest Holster Platform Placed Holster.
Figure 3:
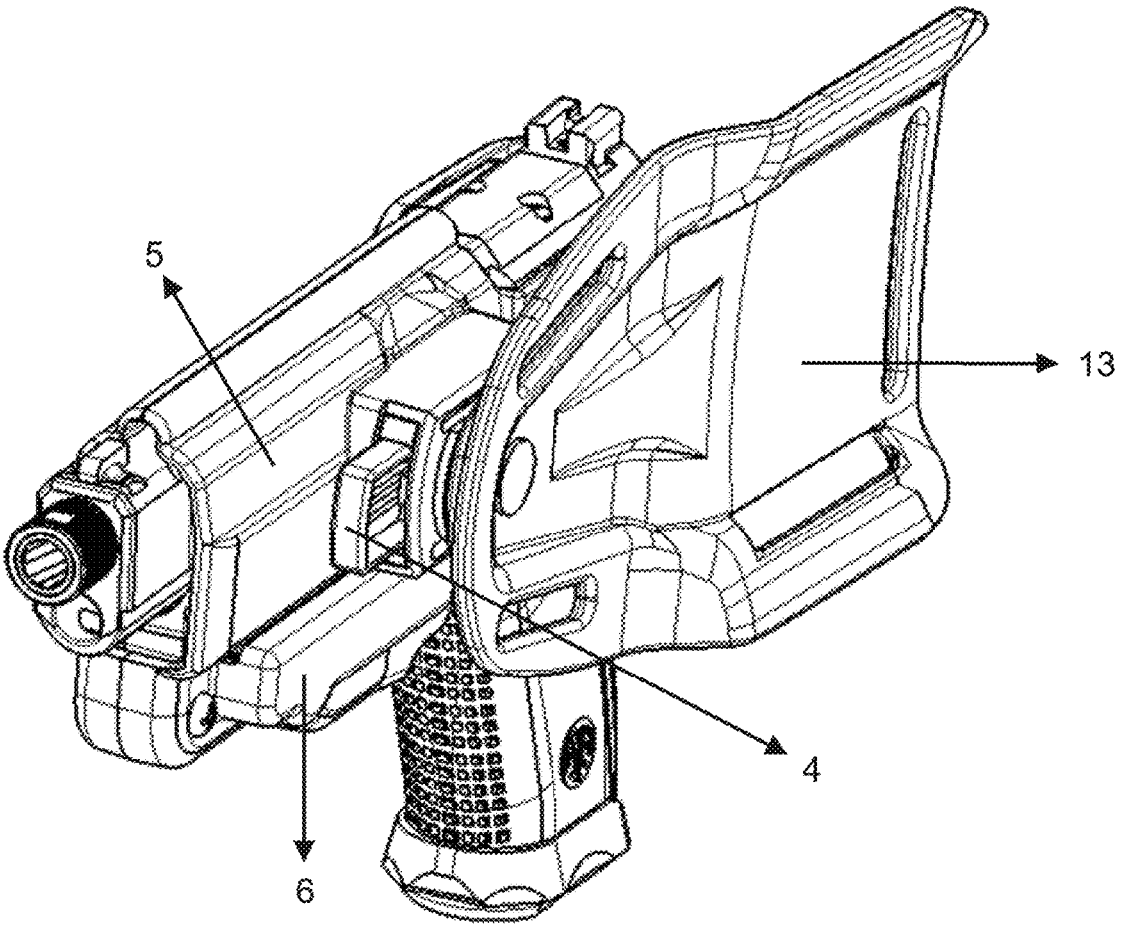
FIG. 3 Leg and Waist Holster Platform Placed Holster.
Figure 4:
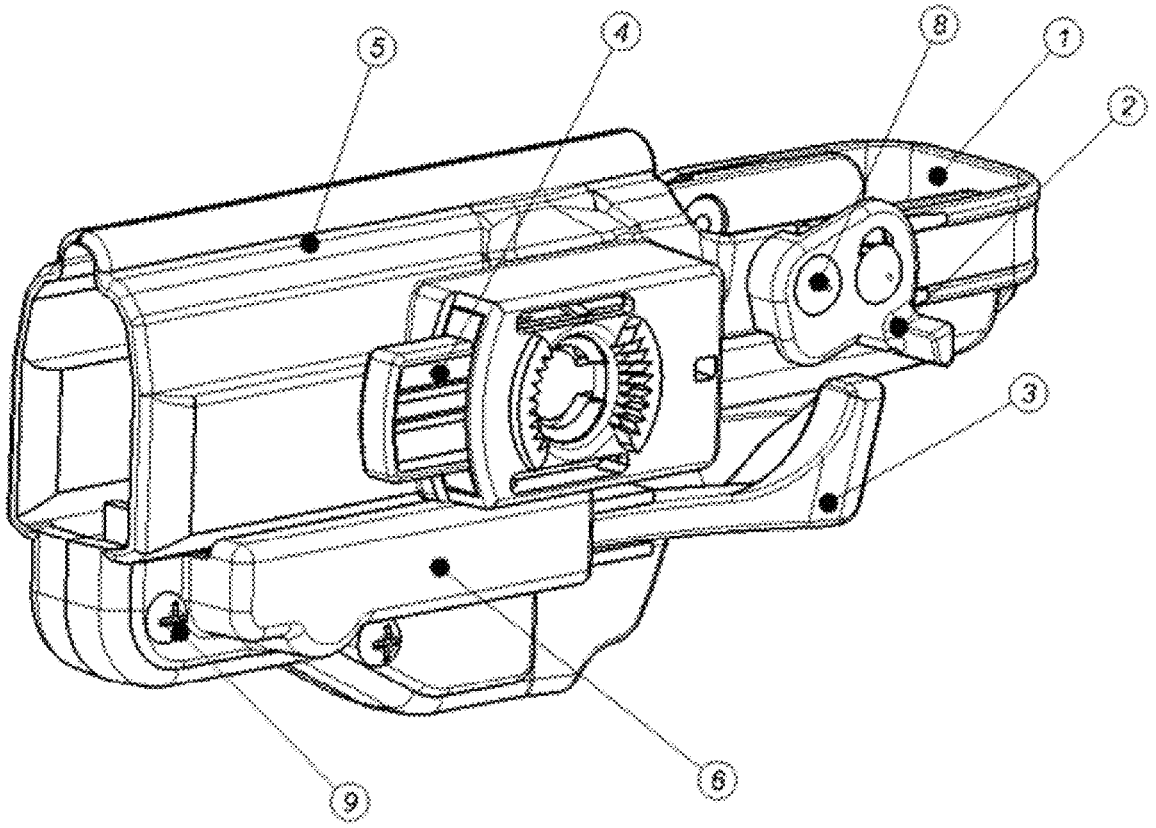
FIG. 4 Holster without the Platform.
Figure 10:
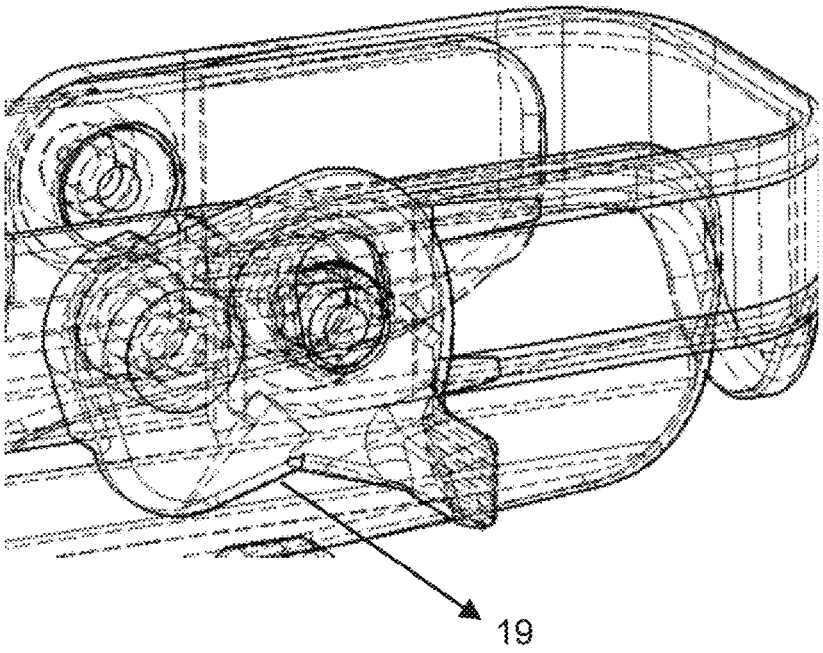
FIG. 10 Upper Lock System Detail.
Figure 11A:
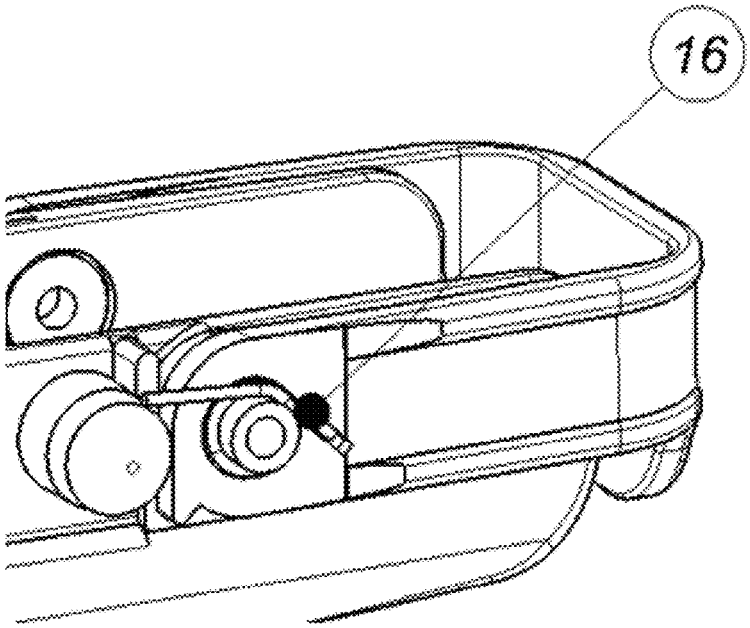
FIG. 11A Showing the Spring Part in Upper Lock System.
Figure 11B:
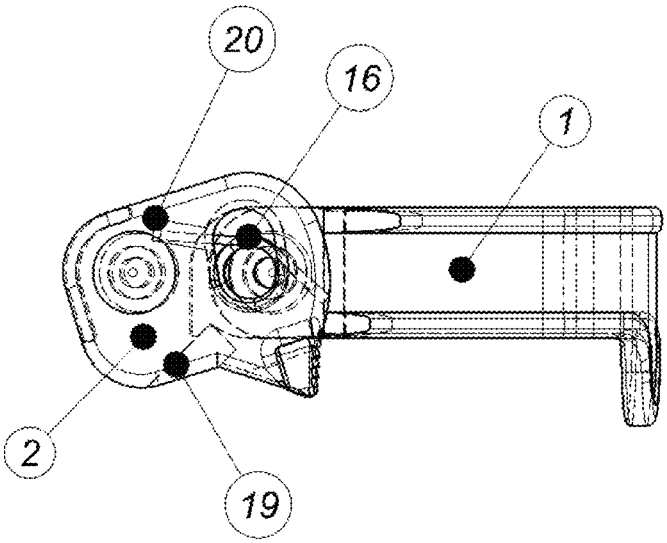
FIG. 11B Upper Lock System Detailed Side View.
Figure 11C:
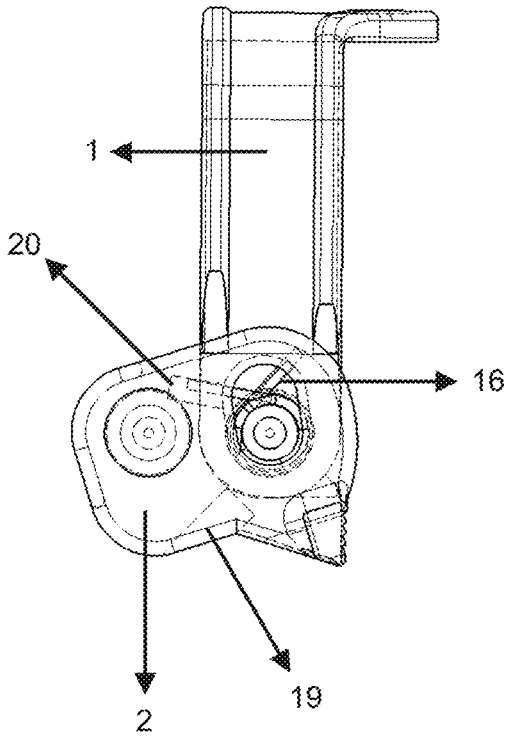
FIG. 11C Upper Lock System in Open Position Detailed Side View.

The invention relates to a system that prevents the pistol from coming out of the holster, unless it is desired by the user with the insertion of the pistol in it. All parts are placed on a body (5). The first part of the invention that prevents the gun from coming off is a cord (1) safety part. When a force is applied downwards to a lever (2) which activates the upper lock system, shown in FIG. 4 and fixed with two lever screws (8), the cord (1) gets loose (FIG. 10) from a locking point (19) by means of a compression spring (16) shown in FIG. 11A, moves forward at a 90° angle to the gun (FIG. 11C) to open the way which is necessary to the gun to come out from the holster. In order to lock the cord (1) part, it is sufficient to return it to its former position manually by the user. The cord (1) is fixed to the holster body with three bolts. The lever (2) comprises a spring channel (20) which further comprises a groove activates the movement of the locking mechanism and prevents the compression spring (16) from being released that prevents the lever (2) from being released.

The holster subject to our invention is produced as two (right-left) molds during production. After a mounting apparatus (4) and a wing spring (14) parts are mounted on the surface of the holster, it is folded and fixed with two screws (9) at the bottom. Thus, it is not possible to detach/remove the wing spring (14), which transfers the force applied to the mounting apparatus (4) and the mounting apparatus (4) to a lock wing (4.1).

Figure 5:
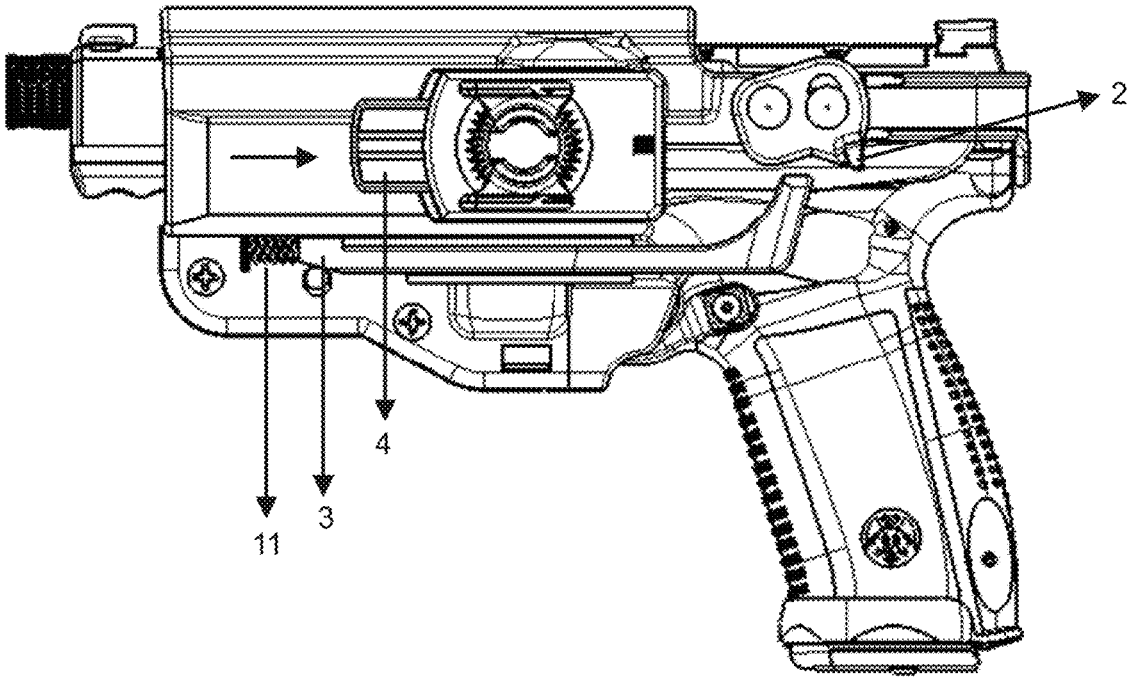
FIG. 5 Holster with its Protective Cover Concealed.
Figure 6:
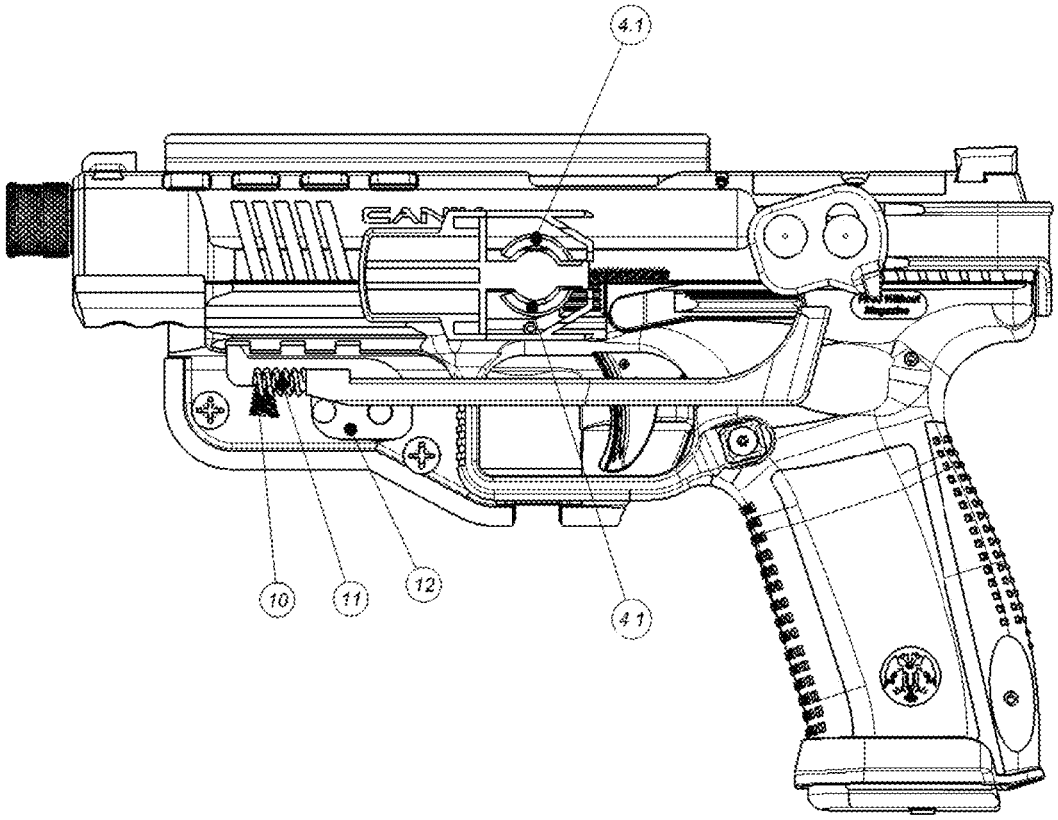
FIG. 6 Holsters Interior Detail View.
Figure 7:
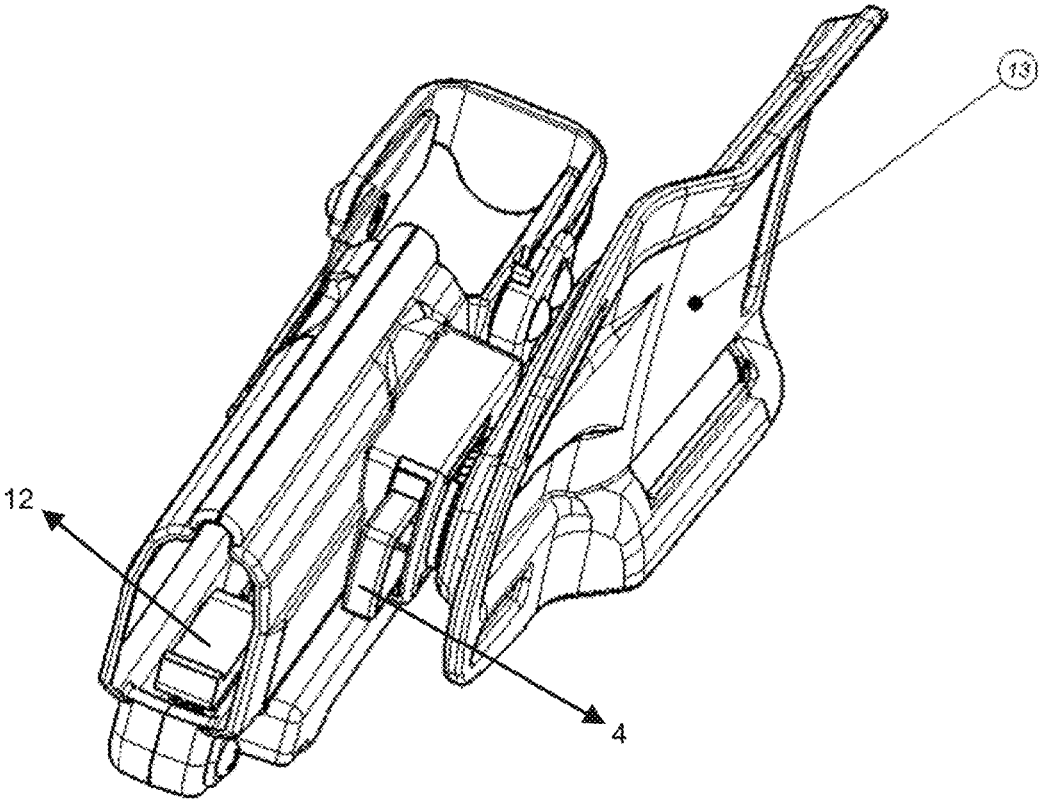
FIG. 7 Leg and Waist Holster Platform Placed Holster.
Figure 8:
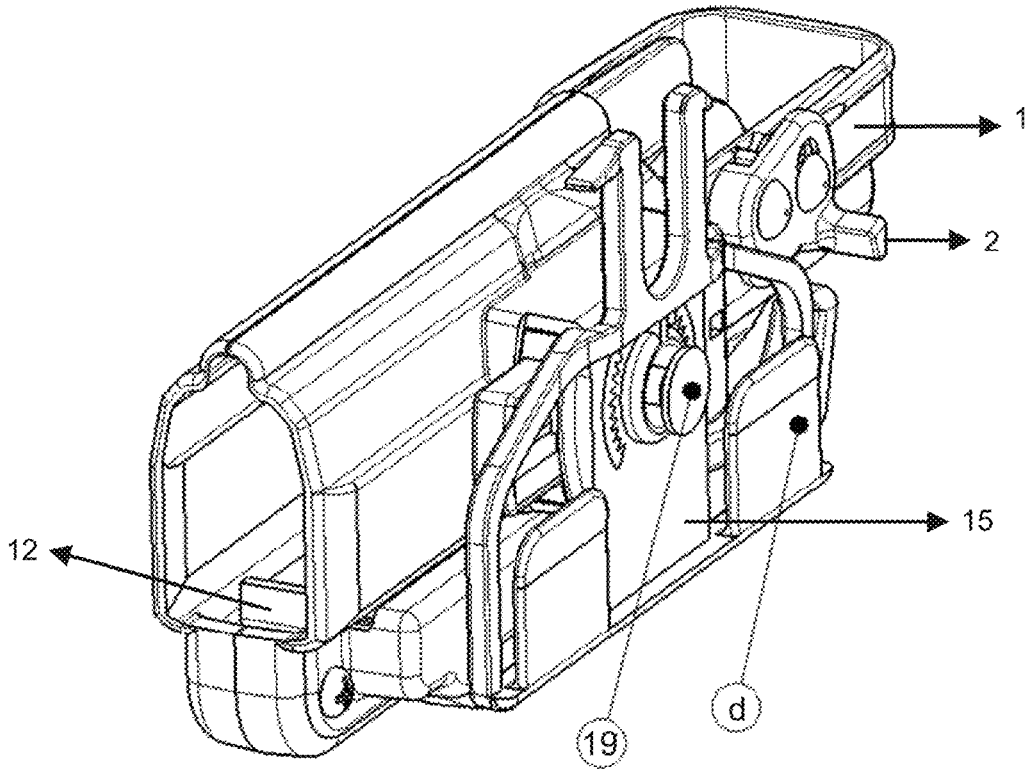
FIG. 8 Chest Holster Platform Placed Holster.
Figure 9:
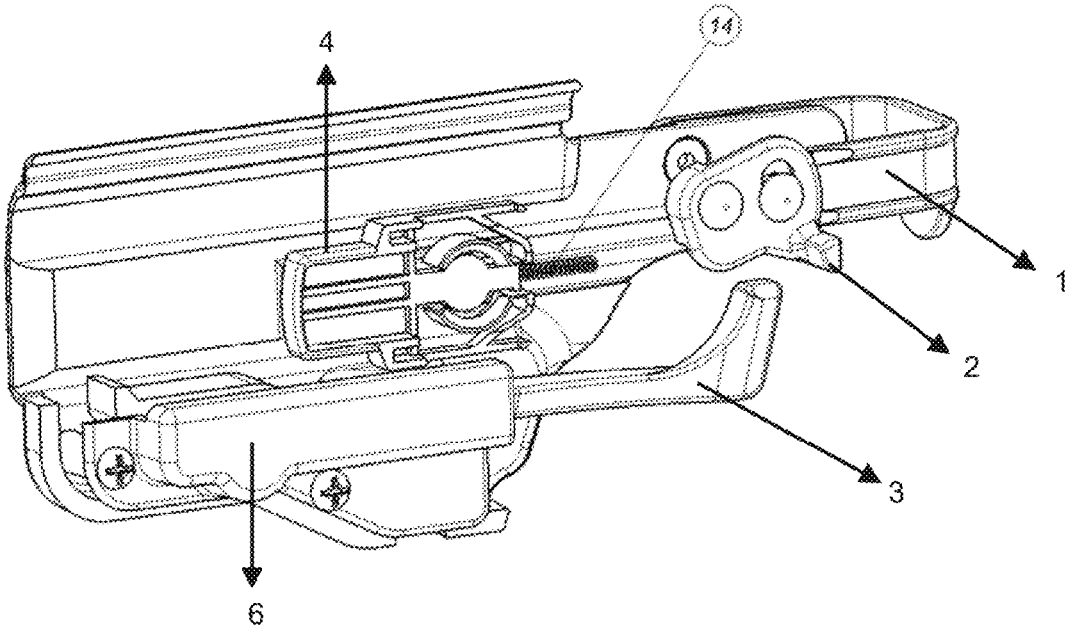
FIG. 9 Interior Detail Specified Holster.

The mounting apparatus (4) described above is used to mount the holster on the chest and leg platforms. A buckle inner fixer (17) and a buckle outer fixer (18) screwed to the buckle inner fixer (17) are fixed on both the leg and chest sheath platform. When the mounting apparatus (4) is pressed in the direction of the arrow shown in FIG. 5, the lock wings (4.1) located in the mounting apparatus (4) are opened and provide the buckle inner fixer (17) on the platforms to be free by being released from a levelled part (17.1). For the assembly of a different platform, the mounting apparatus (4) is pressed again, the lock wings (4.1) are opened and the desired platform is placed.

A lock part (12) performs another locking by entering between the lock wings (4.1) of the picatinny rail in addition to the locking task performed by the cord (1) part. That is, the pistol is locked into the holster with two parts. Locking system of the picatinny rail from the lock wings (4.1) is provided with a picatinny rail release lever (3), a lock part spring (10), a picatinny rail compression spring (11) and the lock part (12). When the picatinny rail release lever (3) is pushed, the picatinny rail compression spring (11) will be compressed and provides the lock part (12) to move down and the gun to be released from the lock wings (4.1). The gun can be locked when it is inserted into the holster by means of the lock part spring (10) positioned under the lock piece and the picatinny rail compression spring (11) placed on the end of the picatinny rail release lever (3) without the need for any touch. A cover (6) protects the defined locking mechanism from external factors.

The leg and waist buckle (13) allow the holster to be used for the calf and the leg. Waist belt slots (a) on the leg and waist buckle (13) are inserted into the waist/bandolier belt. The leg strap slot (b) is inserted into the leg strap, allows the product to be converted into a holster for the calf. The strap is inserted into the leg strap slot (c) on the same piece then the strap is passed through the belt and it can be converted into a holster for the leg by passing the leg strap through the leg strap slot (c).

The invention also allows the holster to be used on the chest via the chest holster buckle (15). The chest holster buckle (15) is inserted into the chest by pressing the chest holster hooks (e) shown in FIG. 15 and FIG. 16. Said chest holster hooks (e) also prevent the gun from coming off during pulling. A chest holster holder (d) passes through the straps in the chest and is locked in the chest and prevents the platform from falling down. This movement is provided by the stretching movement of the chest holster holder (d).

Figure 13:
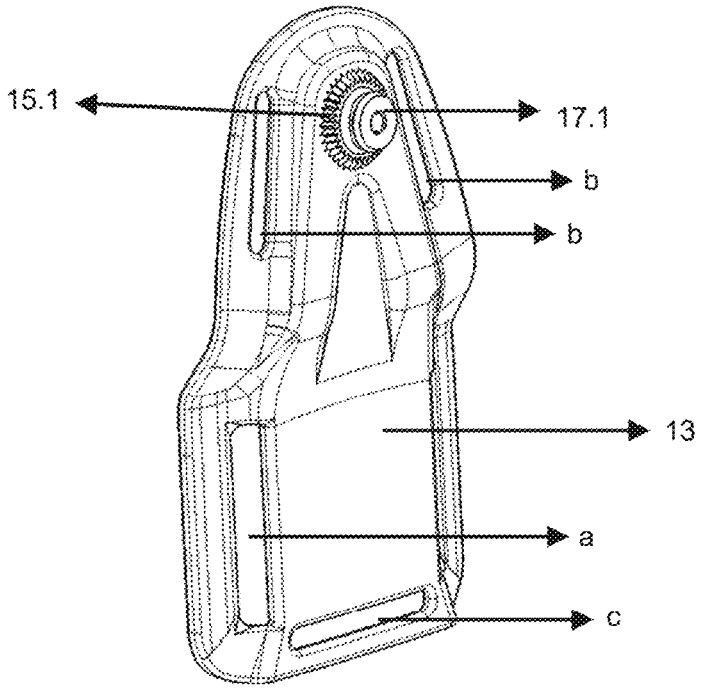
FIG. 13 Front View of the Leg and Waist Platform.
Figure 14:
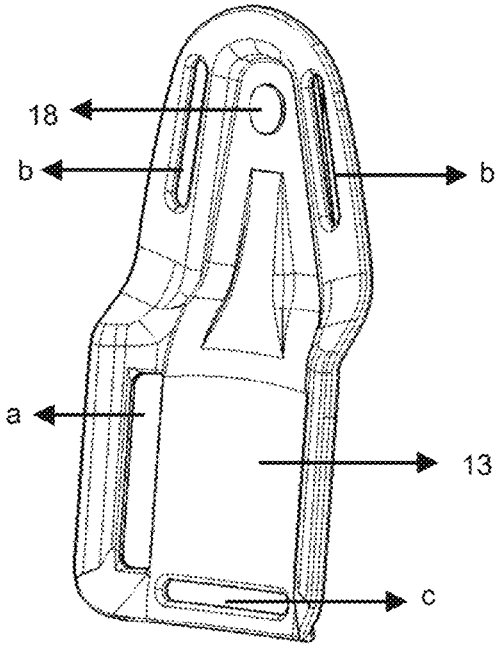
FIG. 14 Rear View of the Leg and Waist Platform.
Figure 15:
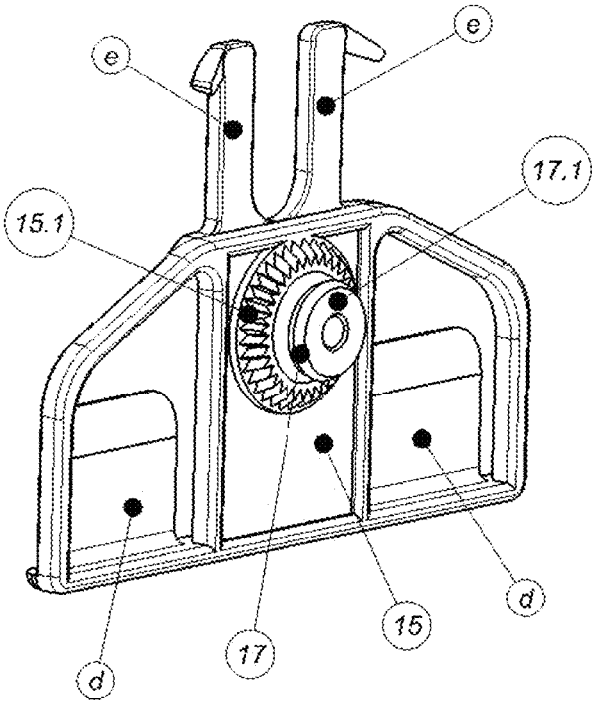
FIG. 15 Front View of the Chest Holster Platform.
Figure 16:
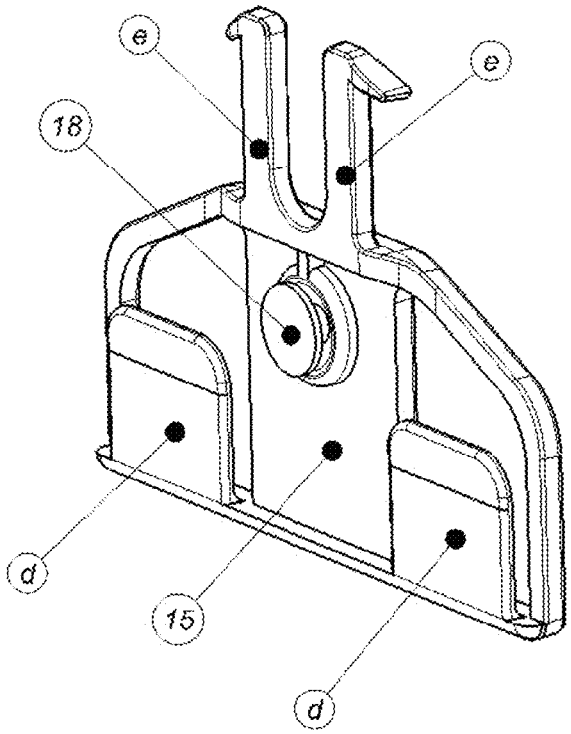
FIG. 16 Rear View of the Chest Holster Platform.
Figure 17:
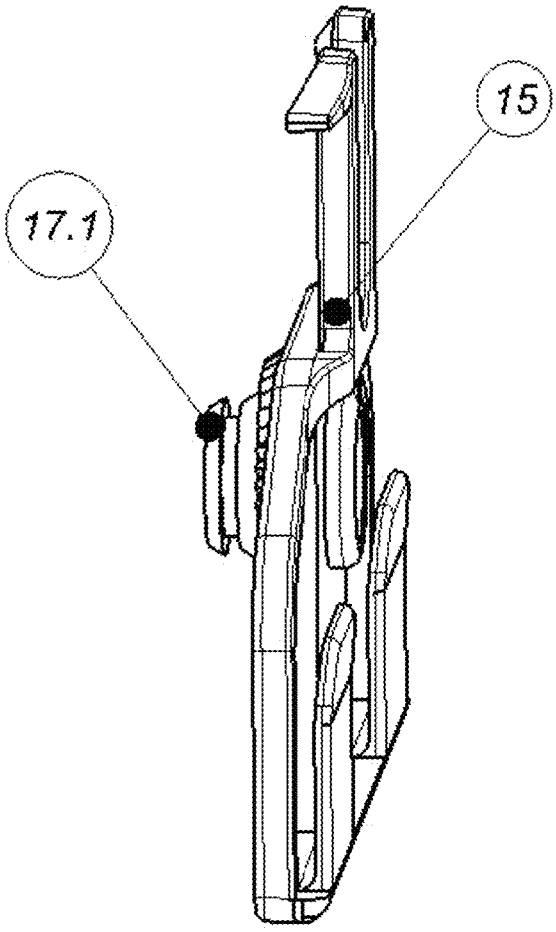
FIG. 17 Side View of the Chest Holster Platform.

The leg and waist buckle (13) and the chest holster buckle (15) comprise a buckle inner fixer (17) with an adjustment gear (15.1) as can be seen in FIG. 13 and FIG. 15. The recesses and protrusions on this adjustment gear (15.1) fully fit with the recesses and protrusions on the lock wings (4.1). To adjust the gun in the desired position depending on the ease of use, the mounting apparatus (4) is pressed, the lock wings (4.1) are opened and the platform is placed at the desired angle thanks to the adjustment gear (15.1).

Figure 12:
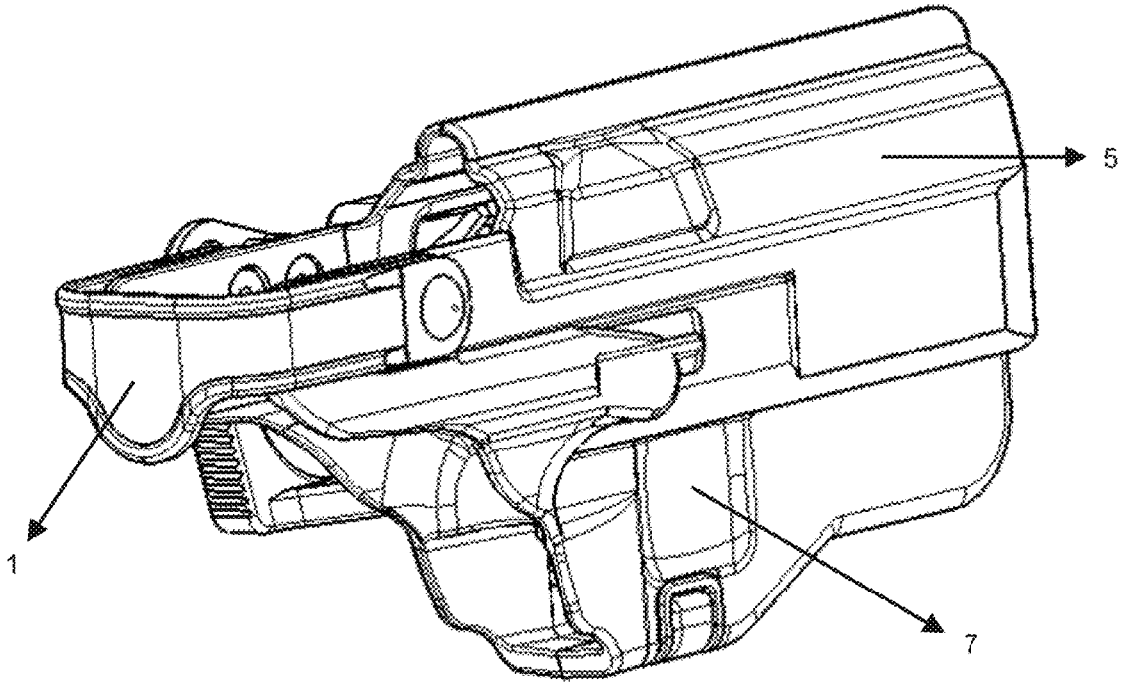
FIG. 12 Back Surface of the Holster.

The recess (7) on the holster shown in FIG. 12 provides protection by preventing the gun from falling out of the holster (except that there is a lot of shaking) without the need for any extra locks. The said recess (7) fits into the trigger cavity when the gun is placed inside the holster. The recess (7) that enters the trigger cavity allows the gun to be released by stretching outwards only with the conscious and strong pull of the gun.

What is claimed is:

1. A lock system for a holster holding a gun having a picatinny rail, the lock system comprising;

a body;

a lever, wherein the lever provides a cord getting loose from a locking point by a compression spring, wherein the compression spring is placed in a spring channel when a force is applied downwards;

a picatinny rail release lever, wherein the picatinny rail release lever is placed between the holster and a platform of the body, wherein a lock part is provided that moves down when the picatinny rail release lever is pushed to release the lock part from the picatinny rail of the gun, a picatinny rail compression spring enabling the lock part to move downwards when the picatinny rail release lever is pushed, wherein the lock part performs a locking by entering between part of the picatinny rail, a mounting apparatus, wherein the mounting apparatus comprises lock wings that are attached to or released from a buckle inner fixer, the buckle inner fixer having an adjustment gear thereon;

wherein the body has a cover and a recess, wherein the recess fits into a trigger cavity of the gun when the gun is placed into the holster; and a leg and waist buckle, a wing spring, wherein the wing spring enables the lock wings to be opened by transmitting a force when the mounting apparatus is pressed, a chest holster buckle, and a buckle fixer fastener screwed to the buckle inner fixer.

2. The lock system of claim 1, wherein the leg and waist buckle comprises a waist belt slot and a first leg strap slot, wherein a waist belt/bandolier is inserted in the waist belt slot, a leg strap is inserted into the first leg strap slot, and a strap is passed through a second leg strap slot.

3. The lock system of claim 1, wherein the chest holster buckle comprises a chest holster hook enabling the chest holster buckle to be held on a user's chest and to be taken out by being pressed and a chest holster holder passing through chest straps.

4. The lock system of claim 1, wherein the buckle inner fixer comprises the adjustment gear, wherein the lock wings are attached and fit to the adjustment gear.

5. The lock system of claim 1, wherein the lever comprises a groove, the spring channel activates a movement of the locking part and prevents the compression spring and the lever from being released.

* * * * *